US011338177B1

(12) United States Patent
Costa et al.

(10) Patent No.: US 11,338,177 B1
(45) Date of Patent: May 24, 2022

(54) GOLF BALL AND METHOD OF MAKING SAME

(71) Applicant: Acushnet Company, Fairhaven, MA (US)

(72) Inventors: Edward Costa, East Providence, RI (US); Erin C. McDermott, Providence, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 17/188,325

(22) Filed: Mar. 1, 2021

(51) Int. Cl.
*A63B 37/06* (2006.01)
*A63B 37/00* (2006.01)
*A63B 102/32* (2015.01)

(52) U.S. Cl.
CPC ..... *A63B 37/0064* (2013.01); *A63B 37/0054* (2013.01); *A63B 37/0056* (2013.01); *A63B 2102/32* (2015.10)

(58) Field of Classification Search
CPC .... A63B 37/0064; A63B 37/005–0069; A63B 37/0054; A63B 37/0056
USPC ..... 446/341–385
See application file for complete search history.

(56) References Cited

U.S. PATENT DOCUMENTS 711,529 A * 10/1902 Richards ..... A63B 37/0003 473/370
719,500 A * 2/1903 Painter ..... A63B 37/0003 473/363
790,252 A * 5/1905 Du Mahaut ..... A63B 37/0097 473/355
2,364,955 A * 12/1944 Diddel ..... A63B 37/0097 473/372
4,085,937 A * 4/1978 Schenk ..... A63B 37/0003 260/998.14
4,531,742 A * 7/1985 Craycraft ..... A63B 69/3688 273/DIG. 8
4,995,613 A * 2/1991 Walker ..... A63B 69/3655 264/162
5,050,886 A * 9/1991 Yamagishi ..... A63B 37/0062 473/372
5,688,192 A * 11/1997 Aoyama ..... A63B 37/0003 473/369
5,823,889 A * 10/1998 Aoyama ..... A63B 37/0003 473/374
6,139,447 A * 10/2000 Ohama ..... A63B 37/0003 473/377
6,186,906 B1 * 2/2001 Sullivan ..... A63B 37/0003 273/DIG. 20
6,361,453 B1 * 3/2002 Nakamura ..... A63B 37/0003 473/371
6,595,874 B2 * 7/2003 Sullivan ..... A63B 37/0003 473/371

(Continued)

*Primary Examiner* — Eugene L Kim
*Assistant Examiner* — Matthew B Stanczak
(74) *Attorney, Agent, or Firm* — Margaret C. Barker

(57) ABSTRACT

Golf ball comprising a core and a cover, wherein the core includes between 2 and 20 smaller spheres that are surrounded by a second core composition having at least one different physical property than the composition(s) forming the smaller spheres. The smaller spheres can be entirely surrounded by the second core composition; or, at least two smaller adjacent spheres may each be partially surrounded by the second core composition while also being in partial contact with each other.

6 Claims, 5 Drawing Sheets

(56) References Cited

U.S. PATENT DOCUMENTS

| | | | | |
|---|---|---|---|---|
| 6,634,962 | B2 * | 10/2003 | Sullivan | A63B 37/00 473/374 |
| 6,835,146 | B2 * | 12/2004 | Jordan | A63B 37/0003 473/377 |
| 6,929,567 | B2 * | 8/2005 | Sullivan | A63B 37/0003 473/374 |
| 7,086,966 | B2 * | 8/2006 | Ohama | A63B 37/0003 473/370 |
| 7,182,700 | B2 * | 2/2007 | Endo | A63B 37/0003 473/370 |
| 7,211,007 | B2 * | 5/2007 | Sullivan | A63B 37/0003 473/374 |
| 7,402,271 | B2 | 7/2008 | Morgan | |
| 7,435,192 | B2 * | 10/2008 | Sullivan | A63B 37/0003 473/378 |
| 9,220,951 | B1 * | 12/2015 | Comeau | A63B 37/0023 |
| 9,265,997 | B1 * | 2/2016 | Good, Jr. | A63B 37/0039 |
| 9,592,426 | B1 * | 3/2017 | DiPietro | A63B 69/3655 |
| 9,782,632 | B1 * | 10/2017 | Breaker | A63B 43/002 |
| 2002/0132684 | A1 * | 9/2002 | Sullivan | A63B 37/0076 473/355 |
| 2003/0022731 | A1 * | 1/2003 | Jordan | A63B 37/0005 473/351 |
| 2005/0197211 | A1 * | 9/2005 | Sullivan | A63B 37/0003 473/371 |
| 2006/0148590 | A1 * | 7/2006 | Sullivan | A63B 37/0003 473/371 |
| 2008/0293517 | A1 | 11/2008 | Morgan | |
| 2011/0009212 | A1 * | 1/2011 | Goguen | A63B 37/005 473/372 |

* cited by examiner

GOLF BALL AND METHOD OF MAKING SAME

FIELD OF THE INVENTION

The field of the invention broadly comprises golf balls incorporating cores having regions of physical property differences therein; and methods of making same.

BACKGROUND OF THE INVENTION

Today, both professional and amateur golfers alike use multi-piece, solid golf balls. For example, in a two-piece solid golf ball construction, a solid core is typically protected by a cover. The core is often made of a natural or synthetic rubber such as polybutadiene, styrene butadiene, or polyisoprene. In turn, the cover may be formed from of a variety of materials such as ethylene acid copolymer ionomers, polyamides, polyesters, polyurethanes, and/or polyureas.

Three-piece, four-piece, and even five-piece golf balls became more popular with the development of manufacturing technologies for efficiently producing same. Multi-layered cores may be comprised, for example, of an inner core containing a relatively soft and resilient material, surrounded by an outer core layer made of a harder and more rigid material. This "dual-core" sub-assembly is then encapsulated by at least one layer such as single or multi-layered cover layer, and optionally one or more intermediate layers to complete the golf ball construction.

Meanwhile, golf ball manufacturers pre-select the materials for each layer to target and impart desirable improved golf ball playing/performance properties/characteristics cost effectively. Currently, a broad range of options are available for strategically incorporating and coordinating layers within each golf ball construction. In multi-layered golf balls, each of the core, intermediate layer and cover can be single or multi-layered, and properties such as hardness, compression, resilience, specific gravity, core diameter, intermediate layer thickness and cover thickness can be preselected and coordinated to target play characteristics such as spin, initial velocity and feel of the resulting golf ball.

In particular, the core is an important part of any golf ball because it acts as an engine or spring for the golf ball. Therefore, golf ball manufacturers continue to improve a core's construction and composition, which are key factors in targeting the resiliency and rebounding performance of the ball.

In this regard, golf ball manufacturers have previously adjusted/modified core properties by dispersing processing aids, fillers, and/or particulates throughout the entire core composition. Additionally, hardness gradients have been created in cores by adjusting the cure profile of the core composition so that core hardness can increase and/or decrease from the core's geometric center radially outward toward its outer surface. In yet other golf ball constructions, property gradients have been created by exposing the core's outer surface to a surface penetrating solution/composition which modifies the properties of the outer surface relative to the remaining portion of the core that is not exposed to the surface penetrating solution/composition. In still other golf ball constructions, core inserts have been disclosed having a hub with and a plurality of outer elements connected to the hub. In these constructions, the hub is a centralized element by which the outer elements are inter-connected at the core center.

However, it is important that modifications to the core do not negatively impact flight symmetry. Flight symmetry is achieved when a golf ball flies at substantially the same height and distance, and remains in flight for substantially the same period of time, regardless of how it is placed on the tee. Without flight symmetry, "hooking" or "slicing" can occur when the golf ball is in flight after being struck by a golf club face. An unbalanced core can also cause the golf ball to roll out of alignment during putting on the course.

Accordingly, there is a need for unique golf balls incorporating novel core constructions that don't sacrifice golf ball flight symmetry and/or putting trajectory. Golf balls of the invention and methods of making same address and fulfill this need.

SUMMARY OF THE INVENTION

Advantageously, a golf ball of the invention incorporates a core comprising a first material that is formed, by a method such as injection molding, compression molding and/or casting, into a plurality of spheres that have at least one physical property that is different than at least one physical property of a second core composition that surrounds the plurality spheres within the core. Thus, the second core composition forms a spherical core member with the plurality of smaller spheres formed from the first core composition dispersed therein. These smaller spheres are spaced from each other and suspended within the surrounding second core composition such that golf ball flight symmetry is achieved and the golf ball does not roll out of alignment during putting on the course.

In one embodiment, a golf ball of the invention comprises a core and a cover, wherein the core has a core center that comprises between 2 and 20 smaller spheres suspended therein. The smaller spheres have diameters of 0.01 to 0.75 inches and are formed of a first rubber composition. The smaller spheres are surrounded by a second core composition having at least one different physical property than the first rubber composition.

In one embodiment, a plurality of the smaller spheres have sphere centers that are equally spaced from the core center.

In another embodiment, the smaller spheres have sphere centers that are equally spaced from the core center.

In a specific embodiment a plurality of the smaller spheres have diameters of between 0.2 inches and 0.5 inches.

In a particular embodiment, an entire outer surface of each smaller sphere is surrounded by the second core composition.

In a different embodiment, the smaller spheres abut at least one adjacent smaller sphere, and more preferably, the smaller spheres abut at least two adjacent smaller spheres.

In one embodiment, the second core composition is selected from the group of thermoset rubber compositions and/or thermoplastic compositions.

In a specific embodiment, the smaller spheres have a diameter that is equal to each other and have a mass that is equal to each other.

In a different embodiment, a first portion of the smaller spheres have a first diameter and a second portion of the smaller spheres have a second diameter that is less than the first diameter.

In another embodiment, a golf ball of the invention comprises a core and a cover, wherein the core has a core center and comprises between 2 and 20 smaller spheres disposed therein. The plurality of smaller spheres have sphere centers and are dispersed substantially symmetrically about, but not concentric with, the core center.

In a specific embodiment, the smaller spheres are formed of a first core composition that has a physical property having a first value and the surrounding portion of the core is comprised of a second core composition that has the physical property having a second value that is different than the first value. For example, the physical property may be selected from the group of hardness, compression, coefficient of restitution, and/or specific gravity. In a specific embodiment, the smaller spheres have a diameter and the smaller sphere centers are spaced from the core center by a distance greater than ½ the diameter. In one particular embodiment, the first core composition is selected from the group of thermoset compositions, such as rubber compositions, thermoplastic compositions, metal-based or metal-containing compositions, and/or blends thereof. Preferably, the second core composition is selected from the group of thermoset compositions, such as rubber compositions, thermoplastic compositions, metal-containing compositions, and/or blends thereof.

A plurality of the smaller spheres are preferably solid or foamed.

Each of a plurality of the smaller spheres may have a hollow portion that is encased by the first core composition.

The invention also relates to a method of making a golf ball comprising the steps of: i) forming a spherical core by: a) forming between 2 and 20 smaller spheres, each having a diameter of from 0.01 inches to 0.75 inches by injection molding, compression molding or casting a first rubber composition; and b) molding a second core composition that has at least one different physical property than the first rubber composition about each of the smaller spheres such that the smaller spheres are uniformly dispersed therein; and ii) forming at least a cover about the spherical core. In this method, an entire outer surface of each smaller sphere may be surrounded by the second core composition. Alternatively, an outer surface of at least one smaller sphere may abut an outer surface of at least one other smaller sphere, and therefore, be partially surrounded by the second core composition.

Preferably, the smaller spheres are all formed of the same first rubber composition. Alternatively, some portion of the smaller spheres may be formed of a different rubber or thermoplastic composition. However, both of these compositions forming the smaller spheres should be different than the composition that forms the surrounding portion of the core.

BRIEF DESCRIPTION OF THE DRAWINGS

These and other aspects of the present invention as set forth in the appended claims may be more fully understood with reference to, but not limited by, following detailed description in connection with the accompanying drawings in which like numerals refer to like elements of the inventive golf ball and method of making same:

DETAILED DESCRIPTION

A golf ball of the invention incorporates a core comprising at least two pre-formed injection molded, compression molded and/or cast volumes of material such as a sphere; each having at least one different physical property than at least one physical property of a second core composition that surrounds the volumes of material. The volumes of material are spaced within a surrounding second core composition of the core before the surrounding second core composition is fully cured such that flight symmetry is achieved and the golf ball does not roll out of alignment during putting on the course.

Accordingly, in golf balls of the invention, smaller spheres may be oriented in any geometry symmetrically about, but not intersecting, the core center. In many embodiments, the entire outer surface of each smaller sphere is surrounded by (and in contact with) a second core composition. In some embodiments, a portion of at least one smaller sphere may abut/contact a portion of an adjacent smaller sphere so that that the surrounding second core composition is in contact with a portion of the outer surface of each of those smaller spheres.

Figure 1A:
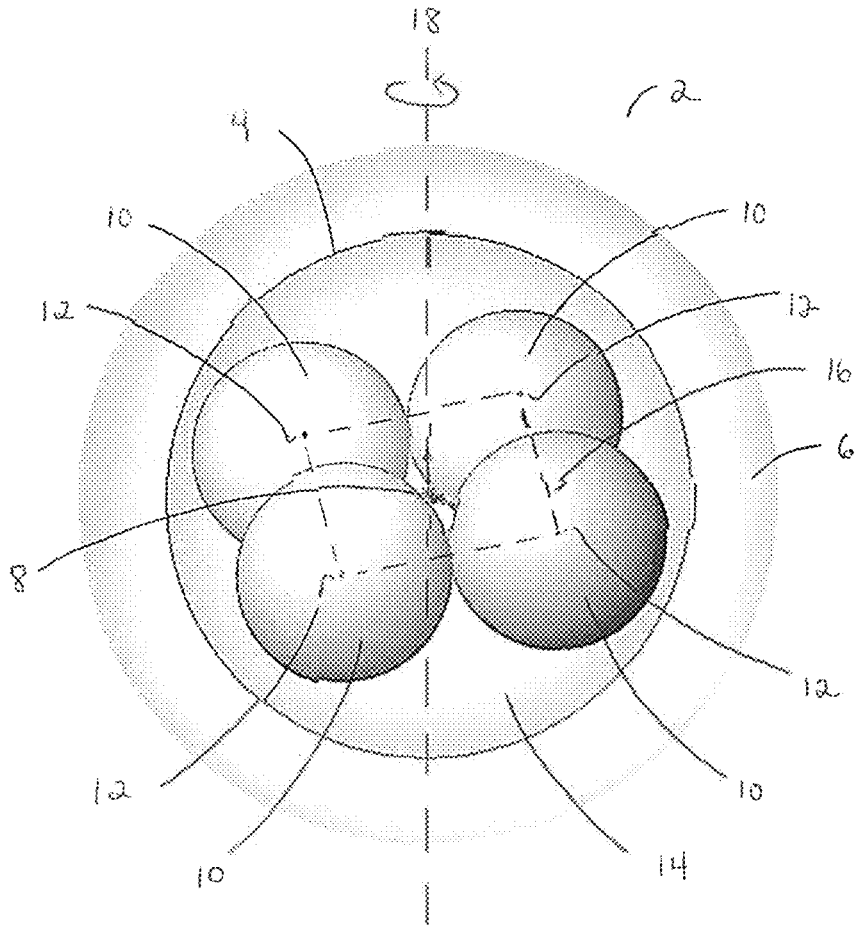
FIG. 1A is a perspective view of a golf ball of the invention according to one embodiment.

The invention may be more fully understood with reference to, but not limited by, FIGS. 1A, 1B, 2A, 2B and 3. Referring to FIG. 1A, golf ball 2 comprises core 4 and cover 6. Core 4 has a core center 8 and four smaller spheres 10 that are disposed about core center 8 and are comprised of a first composition. Each smaller sphere 10 has a sphere center 12, is tangent to two other spheres 10, and is surrounded by second core composition 14 which has at least one different physical property than the first core composition. The four smaller spheres 10 are collectively located in the same plane 16 that is perpendicular to polar axis 18 which intersects core center 8.

Figure 1B:
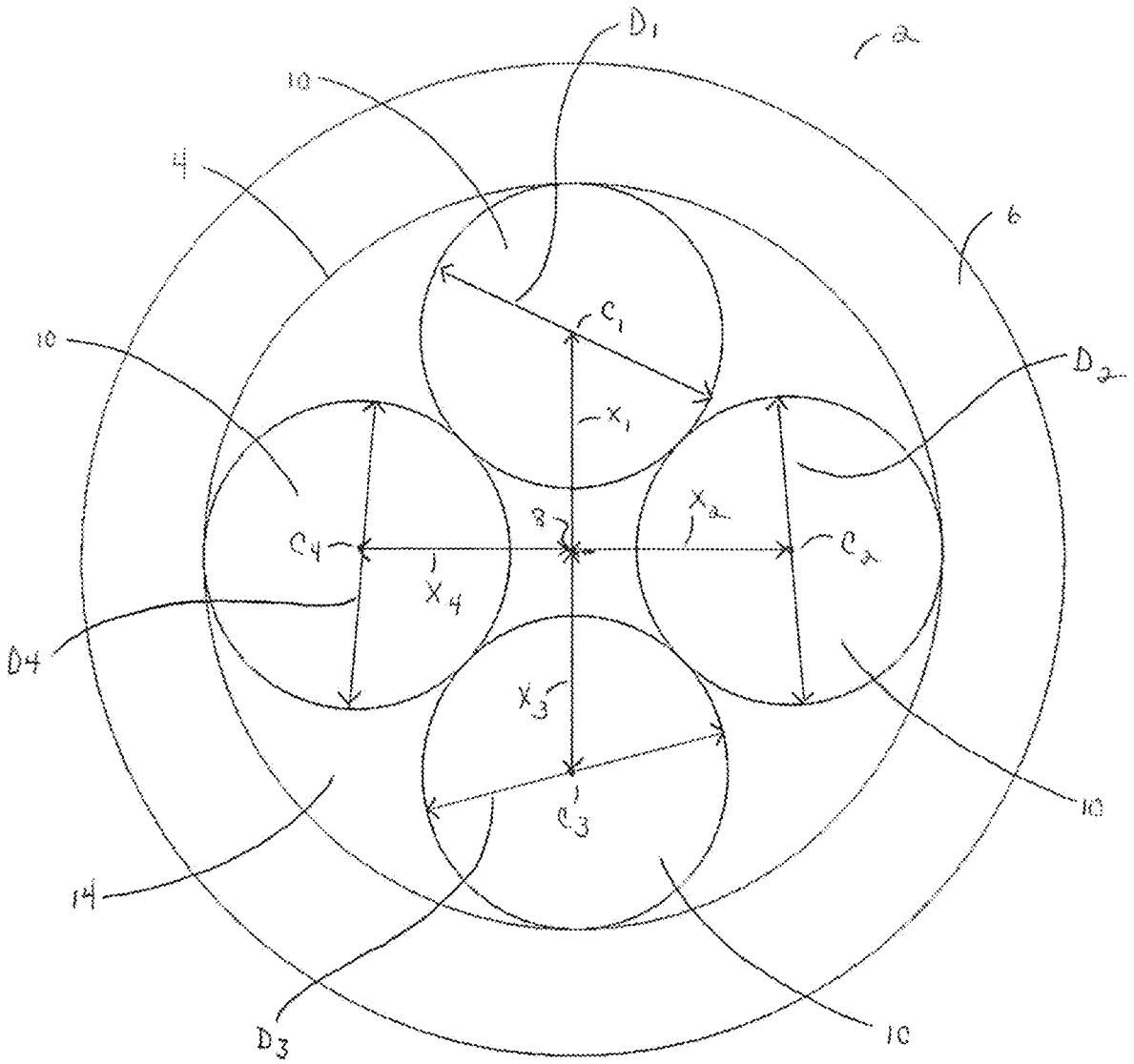
FIG. 1B is a cross-sectional view of the golf ball of the invention according to the embodiment depicted in FIG. 1A.

Meanwhile, FIG. 1B is a cross-sectional view of a golf ball of the invention according to the embodiment depicted in FIG. 1A. In FIG. 1B, first smaller spheres 10 have diameters $D_1$, $D_2$, $D_3$, and $D_4$, wherein $D_1=D_2=D_3=D_4$. Additionally, smaller spheres 10 have sphere centers C1, C2, C3, and C4, respectively (which correspond to sphere centers 12 of FIG. 1A), and each smaller sphere 10 is tangent to two other spheres 10. Sphere centers C1, C2, C3, and C4 of smaller spheres 10 are located distances $X_1$, $X_2$, $X_3$, and $X_4$, respectively, from core center 8. In this embodiment, $X_1=X_2=X_3=X_4$; and $X_1$ is greater than ½ $D_1$.

Figure 2A:
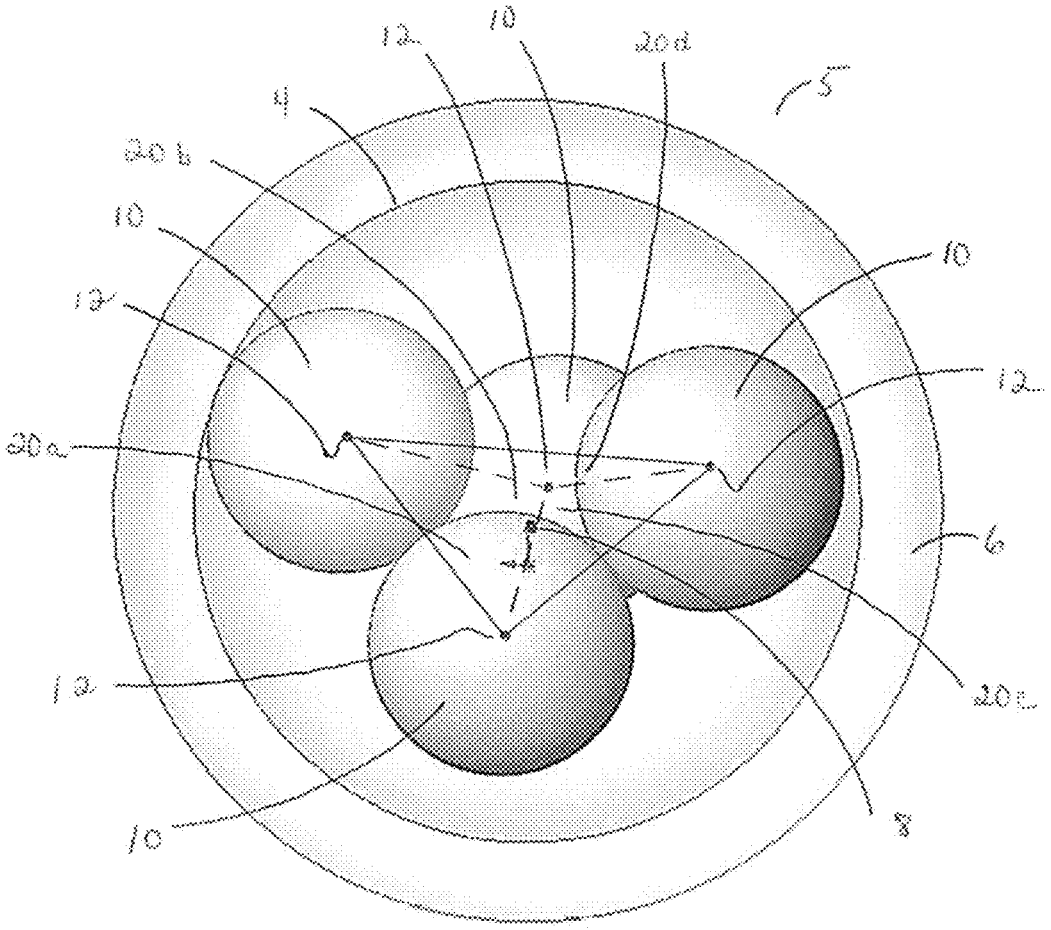
FIG. 2A is a perspective view of a golf ball of the invention according to another embodiment.

Referring to FIG. 2A, golf ball 5 comprises core 4 and cover 6. Core 4 has a core center 8 and four smaller spheres 10 that are comprised of a first core composition. Each smaller sphere 10 has a sphere center 12 and is surrounded by second core composition 14 which has at least one different physical property than the first core composition.

In golf ball 5, four smaller spheres 10 are oriented in a tetrahedron geometry about core center 8 and therefore have 4 axes of rotational symmetry, with each sphere 10 being tangent to two other small spheres 10. The rotational axes pass through each smaller sphere center 12 as well as through a corresponding midpoint on an opposite face 20*a*, 20*b*, 20*c* or 20*d*.

Figure 2B:
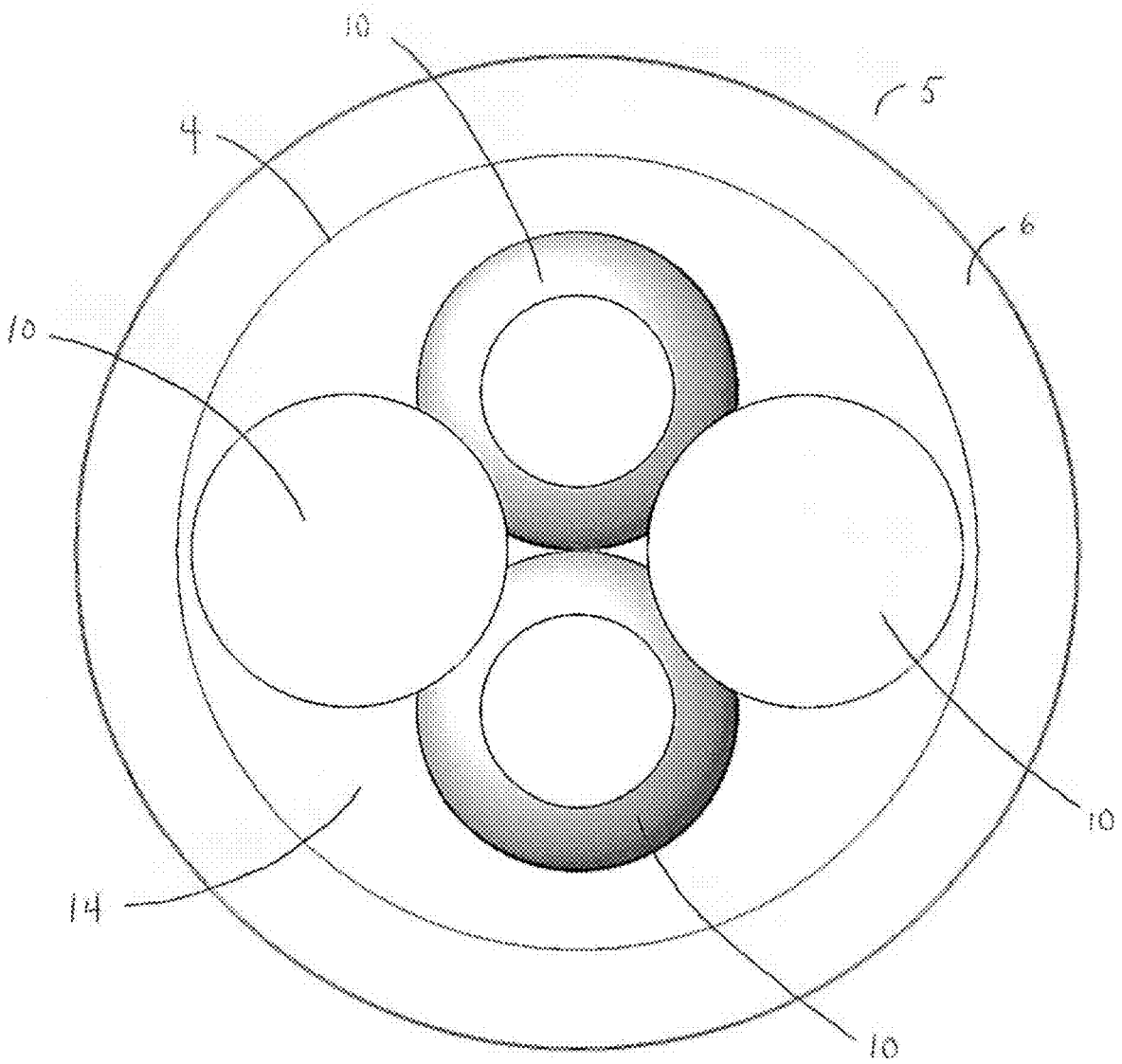
FIG. 2B is a cross-sectional view of a golf ball of the invention according to the embodiment depicted in FIG. 2A.

Meanwhile, FIG. 2B is a cross-sectional view of a golf ball of the invention according to the embodiment depicted in FIG. 2A.

Figure 3:
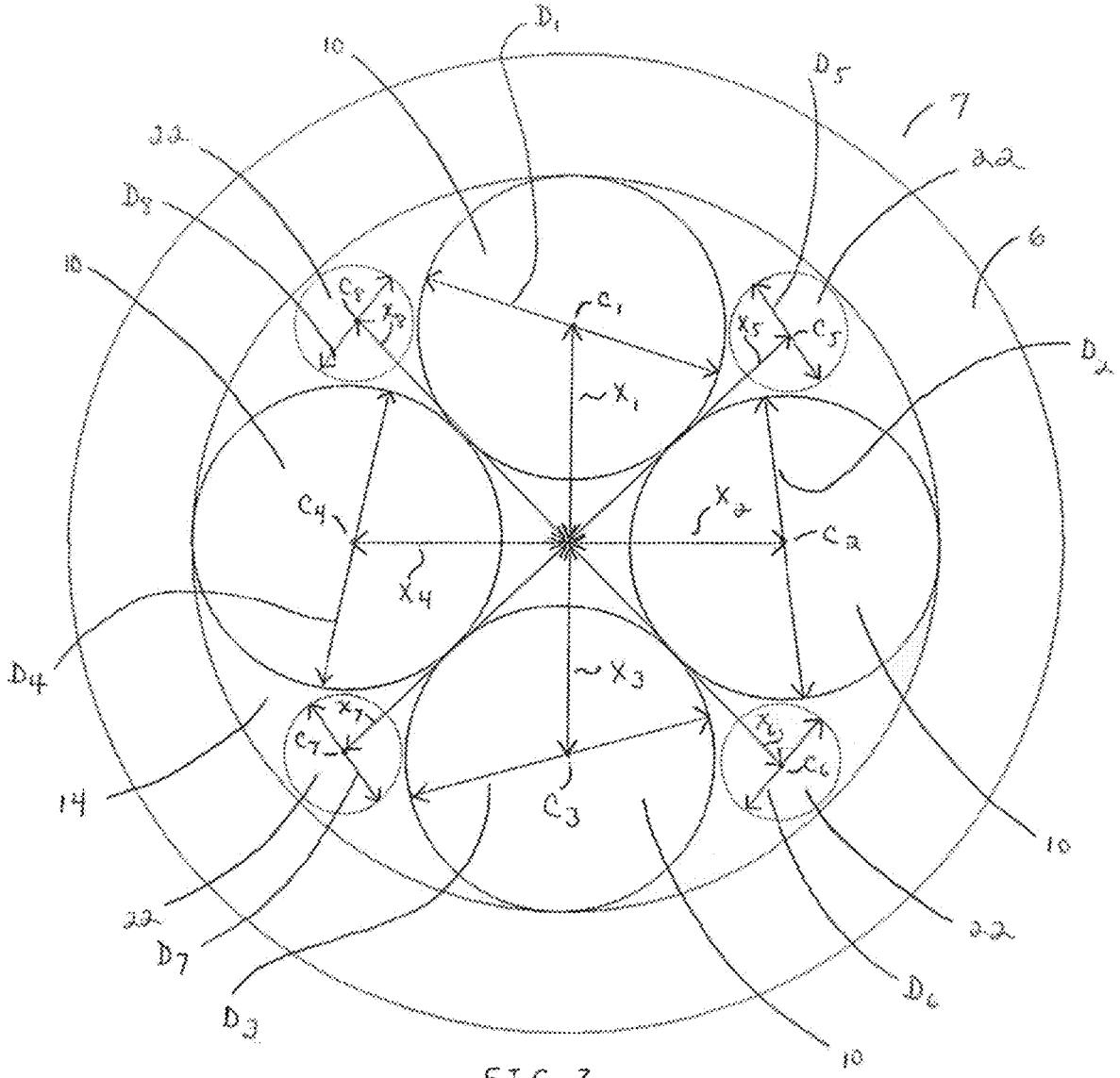
FIG. 3 is a cross-sectional view of a golf ball of the invention according to yet another embodiment.

Additionally, in FIG. 3, golf ball 7 comprises core 4 and cover 6. Core 4 has a core center 8 and four smaller spheres 10 that are disposed about core center 8 and are comprised of a first core composition. First smaller spheres 10 have sphere centers $C_1$, $C_2$, $C_3$, and $C_4$, respectively, and each smaller sphere 10 is tangent to two other spheres 10. As in FIG. 1B, first smaller spheres 10 have diameters $D_1$, $D_2$, $D_3$, and $D_4$, wherein $D_1=D_2=D_3=D_4$; and smaller spheres 10 are located distances $X_1$, $X_2$, $X_3$, $X_4$, respectively, from core center 8, wherein $X_1=X_2=X_3=X_4$; and $X_1$ is greater than ½ $D_1$.

Moreover, in FIG. 3, second smaller spheres 22 surround and are disposed between adjacent smaller spheres 10 and are comprised of a third core composition. Second smaller spheres 22 have sphere centers $C_5$, $C_6$, $C_7$, and $C_8$, respectively, and have diameters $D_5$, $D_6$, $D_7$, and $D_8$, respectively, wherein $D_5=D_6=D_7=D_8$. Second smaller spheres 22 are located distances $X_5$, $X_6$, $X_7$, and $X_8$, respectively, from core center 8, wherein $X_5=X_6=X_7=X_8$; and $D_5$ is less than $D_1$; and $X_5$ is greater than $X_1$.

Meanwhile, each of smaller spheres 10 and smaller spheres 22 are surrounded by second core composition 14 that has at least one different physical property than at least one physical property of the first core composition and the third core composition. In preferred embodiments, the first core composition and third composition have at least one different physical property. However, embodiments are also envisioned wherein the first core composition is the same as the third core composition.

Advantageously, in a golf ball of the invention, smaller spheres 10 may be spaced within the second core composition without intersecting center 8. Instead, each smaller sphere may be entirely surrounded by and suspended/secured within the surrounding second core composition.

In other embodiments, at least one smaller sphere may abut/contact an adjacent smaller sphere so that each smaller sphere is partially surrounded by the surrounding second core composition and partially contacting the adjacent smaller sphere.

In yet another embodiment, each smaller sphere partially contacts two adjacent smaller spheres to create a uniquely shaped continuous band of smaller sphere material that extends circumferentially within and about the smaller sphere and yet is disposed within and between the surrounding second core composition. In this embodiment, the band is comprised of smaller spheres having at least one different physical property than at least one physical property of the surrounding second core composition.

In one particular embodiment, a golf ball of the invention comprises a core and a cover, wherein the core has a core center and comprises between 2 and 20 smaller spheres having diameters of 0.01 to 0.75 inches, the smaller spheres being formed of a first rubber composition and are surrounded by a second core composition having at least one different physical property than the first rubber composition.

For example, the physical property may be selected from the group of hardness, compression, coefficient of restitution, and/or specific gravity.

In another particular embodiment, a golf ball of the invention may comprise a core and a cover, wherein the core has a core center and comprises between 2 and 20 smaller spheres disposed therein, the plurality of smaller spheres having sphere centers and being dispersed substantially symmetrically about, but not concentric with, the core center. In a specific embodiment, all of the smaller spheres have a diameter and the smaller sphere centers are spaced from the core center by a distance greater than ½ the diameter.

In one such embodiment, the smaller spheres are formed of a first core composition that has a physical property having a first value and a surrounding portion of the core is comprised of a second core composition that has the physical property having a second value that is different than the first value. In a different such embodiment, at least one smaller sphere is formed of a first core composition that has a physical property having a first value and at least one other smaller sphere is formed of a different core composition that has a physical property having a different value; and a surrounding portion of the core is comprised of a second core composition that has a physical property having a second value that is different than each of the first value and the different value.

In one embodiment the inventive core may comprise 2-5 smaller spheres. In another embodiment, the core may comprise 4-8 smaller spheres. In yet another embodiment, the core may comprise 5-10 smaller spheres. In still another embodiment, the core may comprise 9-12 smaller spheres. In other embodiments, the core may comprise 11-15 smaller spheres. In alternative embodiments, the core may comprise 13 to 20 smaller spheres. In some embodiments, the core may comprise 16-20 smaller spheres.

Furthermore, there are numerous ways that the smaller spheres can be equally spaced within the second core composition. For example, in one non-limiting embodiment, each smaller sphere can have the same diameter, notwithstanding the preselected number of spheres.

In other embodiments, some smaller spheres can have a different diameter than others. For example, an even number of smaller spheres such as 6, 8, 10, 12, 14, 16, 18, or 20 can be preselected wherein a first half of the smaller spheres has a first diameter, and a second half of the smaller spheres has a second diameter that is smaller than the first diameter. In these embodiments, the first half of the smaller spheres are equally spaced and the second half of the smaller spheres are equally spaced and the first half of the smaller spheres and the second half of the smaller spheres can alternate within the surrounding second core composition.

In a particular embodiment, 9 smaller spheres can be preselected, wherein 3 equally spaced smaller spheres have a first diameter and 6 smaller spheres having a second diameter are equally spaced in groups of two between the 3 smaller spheres. In this embodiment, the first diameter is greater than the second diameter.

In yet another embodiment, 12 smaller spheres can be preselected, wherein 4 equally spaced smaller spheres have a first diameter and 8 smaller spheres having a second diameter are spaced in equally spaced groups of two between the 4 smaller spheres. In this embodiment, the first diameter is greater than the second diameter.

In still another embodiment, 16 smaller spheres can be preselected, wherein 4 equally spaced smaller spheres have a first diameter and 12 smaller spheres having a second diameter are equally spaced in groups of three between the 4 smaller spheres. In this embodiment, the first diameter is greater than the second diameter.

In an alternative embodiment, 18 smaller spheres can be preselected, wherein 6 equally spaced smaller spheres have a first diameter and 12 smaller spheres having a second diameter are equally spaced in groups of two between the 6 smaller spheres. In this embodiment, the first diameter is greater than the second diameter.

In a different embodiment, 20 smaller spheres can be preselected, wherein 4 equally spaced smaller spheres have a first diameter and 16 smaller spheres having a second diameter are equally spaced in groups of four between the 4 smaller spheres. In this embodiment, the first diameter is greater than the second diameter.

In another embodiment, 15 smaller spheres can be preselected, wherein 5 equally spaced smaller spheres have a first diameter and 10 smaller spheres having a second diameter are equally spaced in groups of two between the 5 smaller spheres. In this embodiment, the first diameter is greater than the second diameter.

In a particular embodiment, 16 smaller spheres can be preselected, wherein a first group of 4 equally spaced smaller spheres have a first diameter, and a second group of 4 equally spaced smaller spheres having a second diameter are spaced between each of the 4 equally spaced smaller spheres of the first group, and 8 equally smaller spheres having a third diameter are each spaced between a smaller sphere of the first group and a smaller sphere of the second group. In this embodiment, the first diameter is greater than the second diameter which in turn is greater than the third diameter.

In specific embodiments, the total volume of the smaller spheres may comprise up to one quarter of the total volume of the core, or up to one third of the total volume of the core, or up to one half of the total volume of the core, or at least one quarter of the total volume of the core, or at least one third of the total volume of the core, or at least one half of the total volume of the core, or greater than one quarter of the total volume of the core, or greater than one third of the total volume of the core, or greater than one half of the total volume of the core.

Advantageously, each of the first rubber composition(s)/first core composition(s) and the second core composition can be formed as known in the golf ball art to target a predetermined first value, second value, and third value. Non-limiting examples of physical property differences that can be created within and between each smaller sphere and the surrounding second core composition are as follows.

A hardness gradient of the resulting core is defined by hardness measurements made at the surface of the core and at points radially inward towards the geometric center of the core, typically at 2-mm increments. Given that in some embodiments the smaller spheres are spaced rather than abutting, the hardness measurement profile will be different when taking measurements radially inward from some points on the outer surface of the core than when taking measurements radially inward from other points on the outer surface of the core.

As used herein, the terms "negative" and "positive" hardness gradients refer to the result of subtracting the hardness value at the innermost portion of the component being measured from the hardness value at the outer surface of the component being measured. Accordingly, in cores of the invention, if the outer surface of the core has a lower hardness value than does the geometric center (i.e., the surface is softer than the geometric center), the hardness gradient will be deemed a "negative" gradient (a smaller number−a larger number=a negative number).

And with respect to outer layers, if the outer surface of the outer layer has a has a greater hardness value than the inner surface of the outer core layer, this is a "hard-to-soft" or "positive" hardness gradient as measured radially inward from the outer layer outer surface. It is also possible to create a "zero" hardness gradient, which is generally defined as no gradient as well as a gradient of less than 1 Shore C hardness point in either the negative or positive hardness gradient direction. Methods for measuring the hardness of the inner core and surrounding layers and determining the hardness gradients are well known.

A positive hardness gradient having a magnitude of from about 1 to about 7 Shore C hardness points generally defines a shallow positive hardness gradient. A positive hardness gradient having a magnitude of greater than about 7 to about 22 Shore C hardness points generally defines a "medium" positive hardness gradient. In turn, positive hardness gradient having a magnitude of more than about 22 Shore C hardness points generally defines a "steep" positive hardness gradient.

A hardness gradient having a magnitude within +1 or −1 Shore C hardness point is generally considered to define a "zero" hardness gradient.

And an outer surface hardness that is less than the respective geometric center hardness/inner surface hardness by more than about 1 Shore C hardness point is generally considered to define a negative hardness gradient.

Thus, the core of a golf ball of the invention may have various hardnesses and hardness gradients between the smaller spheres themselves as well as between each smaller sphere and the surrounding second core composition depending on the particular golf ball playing characteristics being targeted. Each smaller sphere is disposed within the surrounding second core composition such that the smaller sphere is suspended within the second core composition rather than being anchored to or interconnected with the center of the core. These novel core constructions permit manufacture of unique resulting golf ball playing characteristics and performance properties.

Core hardness can range, for example, from 35 Shore C to about 98 Shore C, or 50 Shore C to about 90 Shore C, or 60 Shore C to about 85 Shore C, or 45 Shore C to about 75 Shore C, or 40 Shore C to about 85 Shore C. In other embodiments, core hardness can range, for example, from about 20 Shore D to about 78 Shore D, or from about 30 Shore D to about 60 Shore D, or from about 40 Shore D to about 50 Shore D, or 50 Shore D or less, or greater than 50 Shore D.

In one specific non-limiting example, a resulting golf ball of the invention includes a core comprised of smaller spheres with a Shore C hardness of from about 70 Shore C to about 75 Shore C and the surrounding second core composition having a Shore C hardness of from about 85 Shore C to about 90 Shore C; and wherein the Shore C hardness of the surrounding second core composition is greater than the Shore C hardness of at least some of the smaller spheres by at least 15 Shore C hardness points to create a positive Shore C hardness gradient.

In a different example, the hardness of each sphere may be less than a hardness of the surrounding second core composition to define a first positive hardness gradient of about 1 to 12 Shore C hardness points. At least one cover layer is formed over/about this core.

Alternatively, the hardness of each sphere may be less than a hardness of the surrounding second core composition to define a first positive hardness gradient of about 12 to 22 Shore C hardness points. At least one cover layer is formed over/about this core.

In yet other examples, the surrounding second core composition may have hardness that is greater than a hardness of each sphere of the resulting core to define a positive hardness gradient of at least 15 Shore C hardness points.

For example, in one non-limiting example, the smaller spheres may have a hardness of from about 70 Shore C to about 73 Shore C, the hardness of the surrounding second core composition may be from about 86 Shore C to about 89 Shore C; wherein the hardness of the surrounding second core composition is greater than the hardness of each sphere by at least 16 Shore C hardness points.

Embodiments are also envisioned wherein the resulting core has a surrounding second core composition hardness that is greater than the hardness of each smaller sphere to define a positive hardness gradient of at least 20 Shore C hardness points, or at least 25 Shore C hardness points, or at least 30 Shore C hardness points, or at least 35 Shore C hardness points, etc.

In any of these embodiments, at least one cover layer may be formed over/about the core; and optionally, at least one intermediate layer may be disposed between the core and the cover.

Of course, advantageously, a resulting golf ball of the invention comprised of a core created using within a plurality of smaller spheres disposed within surrounding second core composition may have any known hardness gradient and in any known hardness scale in the golf ball art such as Shore C, Shore D, Shore M, etc.

Likewise, a core of a golf ball of the invention may have various compressions and compression differences between the smaller spheres themselves as well as between each smaller sphere and the surrounding second core composition depending on the particular golf ball playing characteristics being targeted.

For example, in one embodiment, all spheres may have the same compression which is lower than a compression of the surrounding second core composition. In another embodiment, all spheres may have the same compression which is greater than a compression of the surrounding second core composition.

In some embodiments, at least one smaller sphere may have a different compression than at least one other smaller sphere. In one such embodiment, alternating smaller spheres have the same compression and all spheres have a compression that is lower than a compression of the surrounding second core composition. In another such embodiment, alternating smaller spheres have the same compression and some smaller spheres have a compression that is lower than a compression of the surrounding second core composition while other smaller spheres have a compression that is greater than a compression of the surrounding second core composition.

In turn, a core of a golf ball of the invention may have various coefficient of restitutions and coefficient of restitution differences between the smaller spheres themselves as well as between each smaller sphere and the surrounding second core composition depending on the particular golf ball playing characteristics being targeted.

For example, in one embodiment, all spheres may have the same coefficient of restitution which is lower than a coefficient of restitution of the surrounding second core composition. In another embodiment, all spheres may have the same coefficient of restitution which is greater than a coefficient of restitution of the surrounding second core composition.

In some embodiments, at least one smaller sphere may have a different coefficient of restitution than at least one other smaller sphere. In one such embodiment, alternating smaller spheres have the same coefficient of restitution and all spheres have a coefficient of restitution that is lower than a coefficient of restitution of the surrounding second core composition. In another such embodiment, alternating smaller spheres have the same coefficient of restitution and some smaller spheres have a coefficient of restitution that is lower than a coefficient of restitution of the surrounding second core composition while other smaller spheres have a coefficient of restitution that is greater than a coefficient of restitution of the surrounding second core composition.

Meanwhile, a core of a golf ball of the invention may have various specific gravities and specific gravity differences between the smaller spheres themselves as well as between each smaller sphere and the surrounding second core composition depending on the particular golf ball playing characteristics being targeted.

For example, in one embodiment, all spheres may have the same specific gravity which is lower than a specific gravity of the surrounding second core composition. In another embodiment, all spheres may have the same specific gravity which is greater than a specific gravity of the surrounding second core composition.

In some embodiments, at least one smaller sphere may have a different specific gravity than at least one other smaller sphere. In one such embodiment, alternating smaller spheres have the same specific gravity and all spheres have a specific gravity that is lower than a specific gravity of the surrounding second core composition. In another such embodiment, alternating smaller spheres have the same specific gravity and some smaller spheres have a specific gravity that is lower than a specific gravity of the surrounding second core composition while other smaller spheres have a specific gravity that is greater than a specific gravity of the surrounding second composition.

It is therefore contemplated that physical property differences can be created between smaller spheres, between each smaller sphere and the surrounding second core composition, and within the surrounding second core composition itself. And it is to be further understood that hardness, compression, coefficient of restitution and/or specific gravity are specific examples of the numerous other physical property differences that can be created within a novel core of the invention and between the novel core of the invention and outer golf ball layers of a resulting golf ball of the invention.

In some embodiments, none of the 2 and 20 smaller spheres contact each other; that is, each smaller sphere is entirely surrounded by the second core composition within the core.

In other embodiments, a portion of an outer surface of at least one smaller sphere may abut/contact a portion of an outer surface of at least one other smaller sphere; but the smaller spheres are not otherwise connected/interconnected.

Advantageously, in a golf ball of the invention, the smaller spheres may be spaced within the second core composition without the need for any central hub and/or without otherwise being interconnected by rods or other interconnecting means or elements/structure.

In one embodiment, a plurality of the smaller spheres have sphere centers that are equally spaced from the core center.

In another embodiment, the smaller spheres have sphere centers that are equally spaced from the core center.

In specific embodiments, smaller spheres may have diameters of 0.01 to 0.75 inches, or between 0.2 inches and 0.75 inches, or between 0.3 inches and 0.75 inches, or between 0.4 inches and 0.75 inches, or between 0.5 inches and 0.75 inches, or between 0.2 inches and 0.5 inches, or between 0.3 inches and 0.5 inches.

In a particular embodiment, the smaller spheres abut at least one adjacent smaller sphere.

In one embodiment, the second core composition is selected from the group of thermoset rubber compositions and/or thermoplastic compositions.

In a specific embodiment, the smaller spheres have a diameter that is equal to each other and have a mass that is equal to each other.

In a different embodiment, a first portion of the smaller spheres have a first diameter and a second portion of the smaller spheres have a second diameter that is less than the first diameter.

For example, the physical property may be selected from the group of hardness, compression, coefficient of restitution, and/or specific gravity.

In a specific embodiment, all of the smaller spheres have a diameter and the sphere centers are spaced from the core center by a distance greater than ½ the diameter.

In a particular embodiment, the first core composition is selected from the group of thermoset compositions, thermoplastic compositions, metal-based compositions, and/or blends thereof. In another specific embodiment, the second core composition is selected from the group of thermoset compositions, thermoplastic compositions, metal-based compositions, and/or blends thereof.

For example, the first core composition and/or second core composition may comprise rubber compositions such as polybutadiene, ethylene-propylene rubber, ethylene-propylene-diene rubber, polyisoprene, styrene-butadiene rubber, polyalkenamers, butyl rubber, halobutyl rubber, polystyrene elastomers, and/or castable liquid rubber compositions.

Additionally, the first core composition and/or second core composition may be comprised for example of partially-neutralized ionomers and highly-neutralized ionomers (HNPs), including ionomers formed from blends of two or more partially-neutralized ionomers, blends of two or more highly-neutralized ionomers, and blends of one or more partially-neutralized ionomers with one or more highly-neutralized ionomers.

Ionomers, typically are ethylene/acrylic acid copolymers or ethylene/acrylic acid/acrylate terpolymers in which some or all of the acid groups are neutralized with metal cations. Commercially available ionomers suitable for use with the present invention include for example SURLYNs® from DuPont and Ioteks® from Exxon. SURLYN® 8940 (Na), SURLYN® 9650 (Zn), and SURLYN® 9910 (Zn) are examples of low acid ionomer resins with the acid groups that have been neutralized to a certain degree with a cation. More examples of suitable low acid ionomers, e.g., Escor® 4000/7030 and Escor® 900/8000, are disclosed in U.S. Pat. Nos. 4,911,451 and 4,884,814, the disclosures of which are incorporated by reference herein. High acid ionomer resins include SURLYN(® 8140 (Na) and SURLYN® 8546 (Li), which have an methacrylic acid content of about 19 percent. The acid groups of these high acid ionomer resins that have been neutralized to a certain degree with the designated cation.

Ionomers may encompass those polymers obtained by copolymerization of an acidic or basic monomer, such as alkyl (meth)acrylate, with at least one other comonomer, such as an olefin, styrene or vinyl acetate, followed by at least partial neutralization. Alternatively, acidic or basic groups may be incorporated into a polymer to form an ionomer by reacting the polymer, such as polystyrene or a polystyrene copolymer including a block copolymer of polystyrene, with a functionality reagent, such as a carboxylic acid or sulfonic acid, followed by at least partial neutralization. Suitable neutralizing sources include cations for negatively charged acidic groups and anions for positively charged basic groups.

The first core composition and/or second core composition may comprise ionomers obtained by providing a cross metallic bond to polymers of monoolefin with at least one member selected from the group consisting of unsaturated mono- or di-carboxylic acids having 3 to 12 carbon atoms and esters thereof (the polymer contains about 1 percent to about 50 percent by weight of the unsaturated mono- or di-carboxylic acid and/or ester thereof). In one embodiment, the ionomer is an E/X/Y copolymers where E is ethylene, X is a softening comonomer, such as acrylate or methacrylate, present in 0 percent to about 50 percent by weight of the polymer (preferably 0 weight percent to about 25 weight percent, most preferably 0 weight percent to about 20 weight percent), and Y is acrylic or methacrylic acid present in about 5 to about 35 weight percent of the polymer, wherein the acid moiety is neutralized about 1 percent to about 100 percent (preferably at least about 40 percent, most preferably at least about 60 percent) to form an ionomer by a cation such as lithium, sodium, potassium, magnesium, calcium, barium, lead, tin, zinc, or aluminum, or a combination of such cations.

The first core composition and/or second core composition may comprise thermosetting poylurethanes which may be formed as known in the golf ball art.

The first core composition and/or second core composition may comprise thermoplastic polyurethanes such as but not limited to those sold under the tradenames of Texin® 250, Texin® 255, Texin® 260, Texin® 270, Texin®950U, Texin® 970U, Texin®1049, Texin@990DP7-1191, Texin® DP7-1202, Texin®990R, Texin®993, Texin®DP7-1049, Texin® 3203, Texin® 4203, Texin® 4206, Texin® 4210, Texin® 4215, and Texin® 3215, each commercially available from Covestro LLC, Pittsburgh Pa.; Estane® 50 DT3, Estane®58212, Estane®55DT3, Estane®58887, Estane®EZ14-23A, Estane®ETE 50DT3, each commercially available from Lubrizol Company of Cleveland, Ohio; and Elastollan®WY1149, Elastollan®1154$D_{53}$, Elastollan®1180A, Elastollan®1190A, Elastollan®1195A, Elastollan®1185AW, Elastollan®1175AW, each commercially available from BASF; Desmopan® 453, commercially available from Bayer of Pittsburgh, Pa., and the E-Series TPUs, such as D 60 E 4024 commercially available from Huntsman Polyurethanes of Germany.

Other suitable thermoplastic polymers include, but are not limited to, the following polymers (including homopolymers, copolymers, and derivatives thereof: (a) polyester, particularly those modified with a compatibilizing group such as sulfonate or phosphonate, including modified poly (ethylene terephthalate), modified poly(butylene terephthalate), modified poly(propylene terephthalate), modified poly (trimethylene terephthalate), modified poly(ethylene naphthenate), and those disclosed in U.S. Pat. Nos. 6,353,050, 6,274,298, and 6,001,930, the entire disclosures of which are hereby incorporated herein by reference, and blends of two or more thereof; (b) polyamides, polyamide-ethers, and polyamide-esters, and those disclosed in U.S. Pat. Nos. 6,187,864, 6,001,930, and 5,981,654, the entire disclosures of which are hereby incorporated herein by reference, and blends of two or more thereof; (c) polyurethane-polyurea hybrids, and blends of two or more thereof; (d) fluoropolymers, such as those disclosed in U.S. Pat. Nos. 5,691,066, 6,747,110 and 7,009,002, the entire disclosures of which are hereby incorporated herein by reference, and blends of two or more thereof; (e) polystyrenes, such as poly(styrene-co-maleic anhydride), acrylonitrile-butadiene-styrene, poly(styrene sulfonate), polyethylene styrene, and blends of two or more thereof; (f) polyvinyl chlorides and grafted polyvinyl chlorides, and blends of two or more thereof; (g) polycarbonates, blends of polycarbonate/acrylonitrile-butadiene-styrene, blends of polycarbonate/polyurethane, blends of polycarbonate/polyester, and blends of two or more thereof; (h) polyethers, such as polyarylene ethers, polyphenylene oxides, block copolymers of alkenyl aromatics with vinyl aromatics and polyamicesters, and blends of two or more thereof; (i) polyimides, polyetherketones, polyamideimides, and blends of two or more thereof; and (j) polycarbonate/polyester copolymers and blends.

It also is recognized that thermoplastic materials can be "converted" into thermoset materials by cross-linking the polymer chains so they form a network structure, and such cross-linked thermoplastic materials may be used to form the core and intermediate layers in accordance with this invention. For example, thermoplastic polyolefins such as linear low density polyethylene (LLDPE), low density polyethylene (LDPE), and high density polyethylene (HDPE) may be cross-linked to form bonds between the polymer chains. The cross-linked thermoplastic material typically has improved physical properties and strength over non-cross-linked thermoplastics, particularly at temperatures above the crystalline melting point. Preferably a partially or fully-neutralized ionomer, as described above, is covalently cross-linked to render it into a thermoset composition (that is, it contains at least some level of covalent, irreversible cross-links). Thermoplastic polyurethanes and polyureas also may be converted into thermoset materials in accordance with the present invention.

The cross-linked thermoplastic material may be created by exposing the thermoplastic to: 1) a high-energy radiation treatment, such as electron beam or gamma radiation, such as disclosed in U.S. Pat. No. 5,891,973, which is incorporated by reference herein, 2) lower energy radiation, such as ultra-violet (UV) or infra-red (IR) radiation; 3) a solution treatment, such as an isocyanate or a silane; 4) incorporation of additional free radical initiator groups in the thermoplastic prior to molding; and/or 5) chemical modification, such as esterification or saponification, to name a few.

Modifications in thermoplastic polymeric structure can be induced by a number of methods, including exposing the thermoplastic material to high-energy radiation or through a chemical process using peroxide. Radiation sources include, but are not limited to, gamma-rays, electrons, neutrons, protons, x-rays, helium nuclei, or the like. Gamma radiation, typically using radioactive cobalt atoms and allows for considerable depth of treatment, if necessary. For core layers requiring lower depth of penetration, electron-beam accelerators or UV and IR light sources can be used. Useful UV and IR irradiation methods are disclosed in U.S. Pat. Nos. 6,855,070 and 7,198,576, which are incorporated herein by reference. The thermoplastic layers may be irradiated at dosages greater than 0.05 Mrd, or ranging from 1 Mrd to 20 Mrd, or ranging from 2 Mrd to 15 Mrd, or ranging from 4 Mrd to 10 Mrd. In one embodiment, the layer may be irradiated at a dosage from 5 Mrd to 8 Mrd and in another embodiment, the layer may be irradiated with a dosage from 0.05 Mrd to 3 Mrd, or from 0.05 Mrd to 1.5 Mrd.

A plurality of the smaller spheres are preferably solid or foamed.

Each of a plurality of the smaller spheres may have a hollow portion that is encased with the first composition.

The invention also relates to a method of making a golf ball comprising the steps of: i) forming a spherical core by: a) providing between 2 and 20 smaller spheres; each having a diameter of from 0.01 inches to 0.75 inches and being formed by injection molding, compression molding or casting a first rubber composition into the smaller sphere; and b) spacing each smaller sphere within a second core composition that has at least one different physical property than the first rubber composition before the second core composition is fully cured; and ii) forming at least a cover about the spherical core.

In another embodiment, the method of making a golf ball comprises the steps of: providing a spherical core having a core center and between 2 and 20 smaller spheres spaced within the core substantially symmetrically about, but not concentric with, the core center; and forming at least a cover about the core; wherein each smaller sphere comprises a composition that is injection molded, compression molded or cast into the smaller sphere before the smaller sphere is spaced within the core; and wherein each smaller sphere is surrounded in the core by a second core composition having at least one different physical property than the composition of each smaller sphere. Embodiments are envisioned wherein all smaller spheres are formed of the same composition. Alternatively, at least one smaller sphere is formed of a different composition than at least one other smaller sphere. And advantageously, once again, the smaller spheres may be spaced within the surrounding second core composition without the need for any central hub and without otherwise being interconnected by rods or other interconnecting means or element.

It is envisioned that the smaller spheres can be comprised of any material including thermoset materials, thermoplastic materials, foamed materials and/or or metals. In a particular embodiment, the smaller spheres are comprised of polybutadiene rubber.

In some embodiments, the smaller spheres can also vary in size and weight—that is, each sphere may or may not be equal in size and weight to each of the other spheres.

Each smaller sphere can be pre-formed using any known method such as injection molding, compression molding or casting.

Subsequently, each smaller sphere may be formed within the second core composition using methods such as the following. In one embodiment, the surrounding second core composition may be injection molded about each smaller sphere which is secured in place in a predetermined pattern. In another embodiment, casting may be used wherein each smaller sphere is deposited in a predetermined pattern within in a casting mold containing the second core composition before final cure of the second core composition.

In yet another embodiment, each smaller sphere can be deposited within the inner surface a first half-shell comprised of second core composition followed by mating an identical second half shell comprised of second core composition with the first half-shell and thereby also about the smaller spheres followed by compression molding assembly of the first and second half shells and smaller spheres disposed therein.

In some embodiments, every smaller sphere is entirely surrounded by the surrounding second core composition. In other embodiments, some of the smaller spheres are entirely surrounded by the surrounding second core composition while other smaller spheres have an outer surface portion that is in contact with/abutting an outer surface portion of an adjacent smaller sphere. In yet other embodiments, every smaller sphere has an outer surface portion that is in contact with/abuts an outer surface portion of an adjacent smaller sphere.

Thermoset and thermoplastic layers herein may be treated in such a manner as to create a positive or negative hardness gradient within and between golf ball layers. In golf ball layers of the present invention wherein a thermosetting rubber is used, gradient-producing processes and/or gradient-producing rubber formulation may be employed. Gradient-producing processes and formulations are disclosed more fully, for example, in U.S. patent application Ser. No. 12/048,665, filed on Mar. 14, 2008; Ser. No. 11/829,461, filed on Jul. 27, 2007; Ser. No. 11/772,903, filed Jul. 3, 2007; Ser. No. 11/832,163, filed Aug. 1, 2007; Ser. No. 11/832,197, filed on Aug. 1, 2007; the entire disclosure of each of these references is hereby incorporated herein by reference.

After the golf balls have been removed from the mold, they may be subjected to finishing steps such as flash-trimming, surface-treatment, marking, and one or more coating layer may be applied as desired via methods such as spraying, dipping, brushing, or rolling. Then the golf ball can go through a series of finishing steps.

For example, in traditional white-colored golf balls, the white-pigmented outer cover layer may be surface-treated using a suitable method such as, for example, corona, plasma, or ultraviolet (UV) light-treatment. In another finishing process, the golf balls are painted with one or more paint coatings. For example, white or clear primer paint may be applied first to the surface of the ball and then indicia may be applied over the primer followed by application of a clear polyurethane top-coat. Indicia such as trademarks, symbols, logos, letters, and the like may be printed on the outer cover or prime-coated layer, or top-coated layer using pad-printing, ink-jet printing, dye-sublimation, or other suitable printing methods. Any of the surface coatings may contain a fluorescent optical brightener.

The core in a golf ball of this invention provides the ball with a variety of advantageous mechanical and playing performance properties as discussed further below. In general, the hardness, diameter, and thickness of the different ball layers may vary depending upon the desired ball construction. Thus, golf balls of the invention may have any known overall diameter and any known number of different layers and layer thicknesses, wherein the inventive core is incorporated within those layers in order to target desired playing characteristics without sacrificing flight symmetry and putting trajectory.

Herein, a golf ball is considered to achieve flight symmetry when it is found, under calibrated testing conditions, to fly at substantially the same height and distance, and remain in flight for substantially the same period of time, regardless of how it is placed on the tee. The testing conditions for assessing flight symmetry of a golf ball are provided in USGA-TPX3006, Revision 3.0, "Actual Launch Conditions Overall Distance and Symmetry Test Procedure".

Unless otherwise defined, all terms (including technical and scientific terms) used herein have the same meaning as commonly understood by one of ordinary skill in the art of this disclosure. It will be further understood that terms, such as those defined in commonly used dictionaries, should be interpreted as having a meaning that is consistent with their meaning in the context of the specification and should not be interpreted in an idealized or overly formal sense unless expressly so defined herein. Well known functions or constructions may not be described in detail for brevity or clarity.

The terms "about" and "approximately" shall generally mean an acceptable degree of error or variation for the quantity measured given the nature or precision of the measurements. Typical, exemplary degrees of error or variation are within 20 percent (%), preferably within 10%, and more preferably within 5% of a given value or range of values. Numerical quantities given in this description are approximate unless stated otherwise, meaning that the term "about" or "approximately" can be inferred when not expressly stated.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

The terminology used herein is for the purpose of describing particular embodiments only and is not intended to be limiting. As used herein, the singular forms "a", "an" and "the" are intended to include the plural forms as well (i.e., at least one of whatever the article modifies), unless the context clearly indicates otherwise.

The inventive cores according to the present disclosure may be used with practically any type of ball construction. For instance, the golf ball may have a two-piece design, a double cover, or veneer cover construction depending on the type of performance desired of the ball. Other suitable golf ball constructions include dual cores, and multiple intermediate layers.

Different materials may be used in the construction of golf balls according to the present disclosure. For example, the cover of the ball may be made of a thermoset or thermoplastic, a castable or non-castable polyurethane and polyurea, an ionomer resin, balata, or any other suitable cover material known to those skilled in the art. Conventional and non-conventional materials may be used for forming core and intermediate layers of the ball including polybutadiene and other rubber-based core formulations, ionomer resins, highly neutralized polymers, and the like. And it is contemplated that each and all of the smaller spheres and/or the surrounding second core composition of golf balls of the invention may comprise any known golf ball material.

The golf balls of the present disclosure may be formed using a variety of application techniques. For example, the golf ball layers may be formed using compression molding, flip molding, injection molding, retractable pin injection molding, reaction injection molding (RIM), liquid injection molding (LIM), casting, vacuum forming, powder coating, flow coating, spin coating, dipping, spraying, and the like. Conventionally, compression molding and injection molding are applied to thermoplastic materials, whereas RIM, liquid injection molding, and casting are employed on thermoset materials.

The dimple count on the golf balls contemplated by the present disclosure may be varied. As used herein, the "dimple count" of a golf ball refers to how many dimples are present on the golf ball. The total number of dimples may be based on, for instance, the number of differently sized dimples, the maximum and minimum diameters of the dimples, the dimple arrangement, and the desired surface coverage.

In one embodiment, the total number of dimples may be less than about 350 dimples. For example, the total number of dimples on the golf ball may be about 328. In another embodiment, the total number of dimples on the golf ball may be about 344. In still another embodiment, the total number of dimples on the golf ball may be about 348.

In another embodiment, the total number of dimples on the golf ball may range from about 350 dimples to about 500 dimples. For instance, the total number of dimples may be about 352 dimples. In another embodiment, the total number of dimples may be about 388 dimples.

The golf balls described and claimed herein are not to be limited in scope by the specific embodiments herein disclosed, since these embodiments are intended as illustrations of several aspects of the disclosure. Any equivalent embodiments are intended to be within the scope of this disclosure. Indeed, various modifications of the device in addition to those shown and described herein will become apparent to those skilled in the art from the foregoing description. Such modifications are also intended to fall within the scope of the appended claims. All patents and patent applications cited in the foregoing text are expressly incorporated herein by reference in their entirety. Any section headings herein are provided only for consistency with the suggestions of 37 C.F.R. § 1.77 or otherwise to provide organizational queues. These headings shall not limit or characterize the invention (s) set forth herein.

What we claim is:

1. A golf ball comprising a core and a cover, wherein the core has a core center and comprises four first smaller spheres and four second smaller spheres;

wherein the four first smaller spheres:

are disposed about the core center without intersecting it;

are each comprised of a first core composition;

are each tangent to two other first smaller spheres;

have diameters $D_1$, $D_2$, $D_3$, and $D_4$, wherein $D_1=D_2=D_3=D_4$;

are located distances $X_1$, $X_2$, $X_3$, $X_4$, from the core center, wherein:

$X_1=X_2=X_3=X_4$; and $X_1$ is greater than ½ D1; and wherein the four second smaller spheres:

surround and are disposed between adjacent first smaller spheres;

are each comprised of a third core composition;

have diameters $D_5$, $D_6$, $D_7$, and $D_8$, wherein $D_5=D_6=D_7=D_8$;

are located distances $X_5$, $X_6$, $X_7$, and $X_8$ from the core center, wherein:

$X_5=X_6=X_7=X_8$;

$D_5$ is less than $D_1$; and $X_5$ is greater than $X_1$; and wherein each of the first smaller spheres and each of the second smaller spheres is surrounded by a second core composition that has at least one different physical property than at least one physical property of the first core composition and the third core composition.

2. The golf ball of claim 1, wherein the physical property is selected from the group of hardness, compression, coefficient of restitution, and specific gravity.

3. The golf ball of claim 1, wherein the first core composition is selected from the group of thermoset compositions, thermoplastic compositions, metal-based compositions, and blends thereof.

4. The golf ball of claim 1, wherein the second core composition is selected from the group of thermoset compositions, thermoplastic compositions, metal-based compositions, and blends thereof.

5. The golf ball of claim 1, wherein the first smaller spheres and the second smaller spheres are solid.

6. The golf ball of claim 1, wherein at least one first smaller sphere abuts and contacts an adjacent second smaller sphere.

* * * * *